United States Patent [19]

Hayes

[11] 4,241,838

[45] Dec. 30, 1980

[54] HEIGHT-ADJUSTABLE HOIST

[76] Inventor: Calvin L. Hayes, 695 Suncrest Rd., Talent, Oreg. 97540

[21] Appl. No.: 919,426

[22] Filed: Jun. 26, 1978

[51] Int. Cl.[3] ..... B66C 23/36; B66C 23/62

[52] U.S. Cl. ..... 212/255; 414/541

[58] Field of Search ..... 214/75 H; 212/8 R, 61, 212/62, 64, 65, 59 R, 60, 54, 28; 414/543, 540, 541; 254/190 R, 150 R, 186 HC

[56] References Cited

U.S. PATENT DOCUMENTS

| | | | |
|---|---|---|---|
| 2,799,402 | 6/1957 | Norman | 414/543 X |
| 2,804,216 | 8/1957 | Farnam | 214/75 H X |
| 2,940,621 | 6/1960 | White | 214/75 H |
| 3,019,918 | 2/1962 | Keener | 414/543 |
| 3,578,179 | 5/1971 | Fujioka | 214/75 H X |
| 3,978,989 | 9/1976 | Avila | 414/543 X |

*Primary Examiner*—Robert J. Spar
*Assistant Examiner*—Jerold M. Forsberg
*Attorney, Agent, or Firm*—Kolisch, Hartwell & Dickinson

[57] ABSTRACT

A height-adjustable hoist having an upright post, a tip member extensible therefrom, and a sleeve swivelable about the axis of the post. A hoist arm is pivotally mounted at one of its ends on the sleeve for pivoting in a substantially upright plane between raised and lowered positions. A nonextensible chain extending from the other end of the hoist arm to the tip member is adjustably anchored to the tip member by a chain-engaging lock. To set the hoist arm at a desired raised position, the tip member is extended and the chain is selectively anchored to the tip member, with the chain stretched between the hoist arm and tip member.

6 Claims, 4 Drawing Figures

Fig. 1
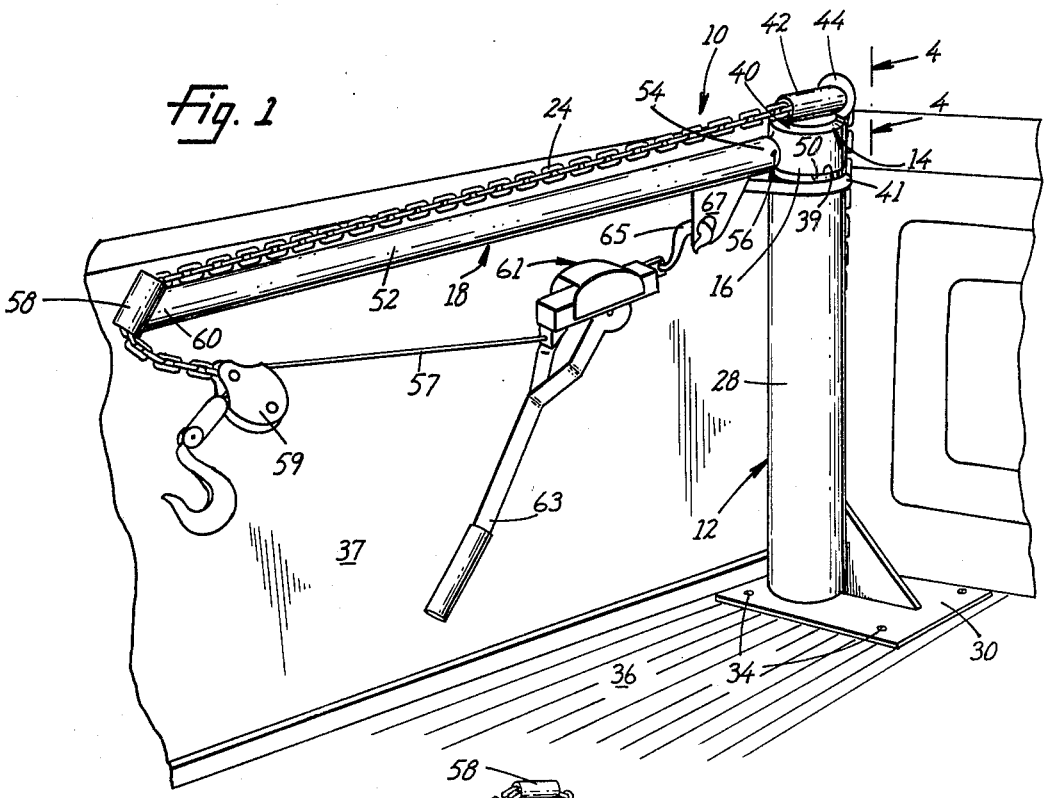
Fig. 2
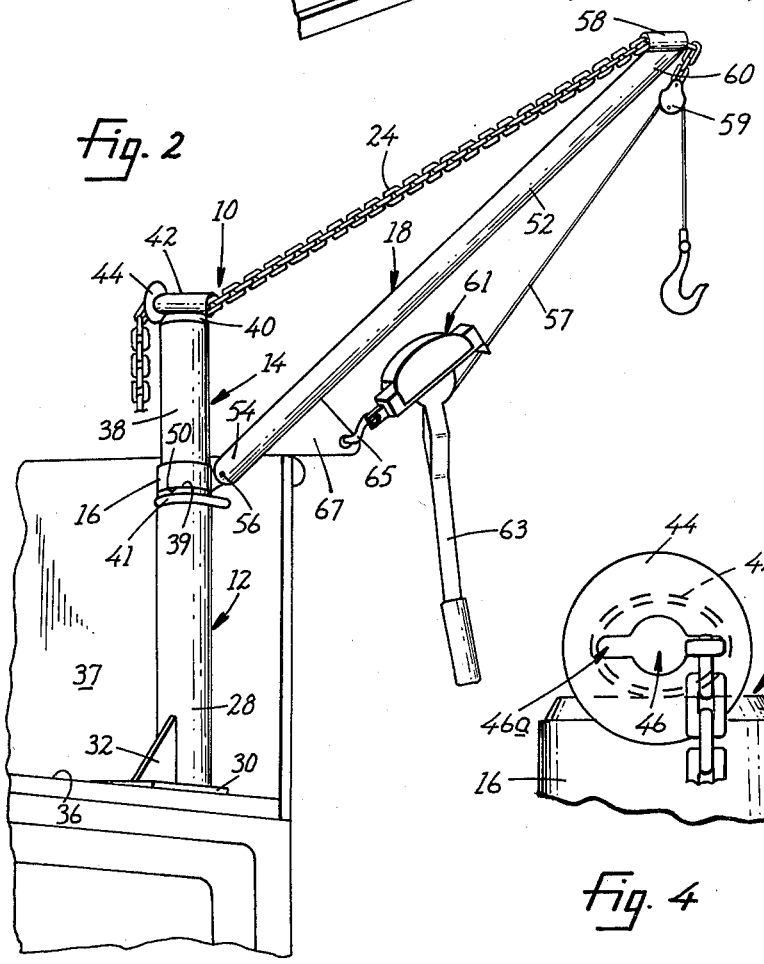
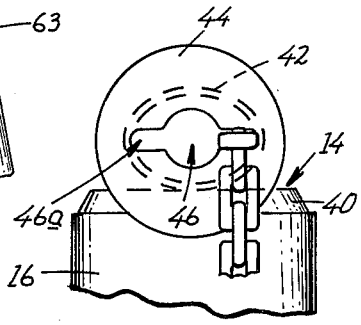
Fig. 4
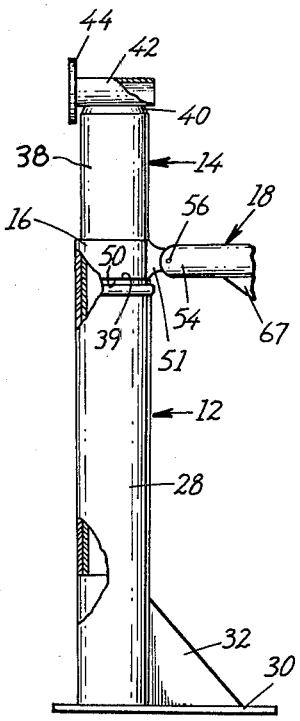
Fig. 3

HEIGHT-ADJUSTABLE HOIST

BACKGROUND AND SUMMARY

This invention relates to hoisting apparatus, and in particular to a height-adjustable hoist adapted to be mounted within, and operated from, the bed of a truck.

One important object of the present invention is to provide a portable hoist having a hoist arm which is pivotable to place the free end of the arm at different adjusted heights and, a simple mechanism for maintaining the free end of the hoist arm at a desired height.

It is another object of the invention to provide a height-adjustable hoist capable of supporting heavy loads.

Yet another object of the invention is to provide an extendible hoist designed to be stationarily mounted within the bed of a truck, with collapsible mast structure in the hoist collapsed to a height which may be substantially that of the sides of the truck.

In a particular embodiment of the present invention, the height-adjustable hoist comprises an upright tubular post adapted to be stationarily mounted on the floor of a truck bed, or the like. Rotatably mounted on the top of the post is a sleeve. A cylindrical tip member is rotatably mounted within the post, and is also slidably extensible from the post, thereby to be slideably positionable between a lowered position in which the top of the tip member is adjacent the upper portion of the post, and a raised position wherein the same are spaced apart. The tip member and post constitute extendible and contractible mast structure in the hoist. A hoist arm is mounted at one of its ends to the sleeve for pivoting in a substantially upright plane. Provided on the hoist arm is a hoist line, a pulley about which the line is trained, and a drum for taking in and paying out the line.

A nonextensible chain extending from the other end of the hoist arm to the top of the tip member serves to establish the angle of the hoist arm in relation to the post. A chain lock on the tip member permits the effective length of the chain to be selectively varied. In operation, the hoist arm is suitably oriented and raised to place it at the desired operating position. The tip member is then raised and the chain is selectively locked in a position wherein the chain is stretched between the tip member and the hoist arm. With the chain in place, the tip member is maintained in its extended position and the angular position of the hoist arm is maintained.

Other objects and features of the present invention will become more apparent from the following detailed description of a preferred embodiment of the invention, and the accompanying drawings.

DRAWINGS

FIG. 1 is a perspective view of a hoist constructed according to a preferred embodiment of the present invention, shown in collapsed position, and mounted within the bed of a truck.

FIG. 2 is a perspective view of the hoist of FIG. 1 shown in an extended, operating position.

FIG. 3 is a side elevation view of the post, and attached sleeve and tip member, with parts cutaway.

FIG. 4 is an enlarged side view of the top of the tip member, taken generally along the line 4—4 in FIG. 1.

DETAILED DESCRIPTION OF A PREFERRED EMBODIMENT OF THE INVENTION

Referring now to FIGS. 1 and 2, there is shown at 10 a height-adjustable hoist constructed according to a preferred embodiment of the invention. Hoist 10 generally comprises an upright tubular post 12, having mounted therein an extensible tip member 14, and a rotatable swivel member or sleeve 16 rotatably supported on top of the post. A hoist arm 18 is mounted on sleeve 16 for pivoting in a substantially upright plane, wherein the arm extends outwardly from the post at an angle. Nonextensible means, more specifically, a link chain 24 extending from arm 18 to member 14, serves to establish the desired angle of arm 18 in relation to the post 12, as will be described.

With reference to FIGS. 1-3, post 12 includes an upright tube 28, which is attached, as by welding, to a base plate 30. The mounting of tube 28 on plate 30 is reinforced by a triangular bracket 32 connecting the two. Suitable fastening means, such as bolts 34 extending through bolt holes in the base plate, serve to mount the plate on an appropriate mounting surface—in the present case, the floor 36 of a truck bed. Post 12 may be secured conventionally at its upper portion to the side 37 of the truck bed by a U-bolt 41.

Member 14 includes a cylindrical tube 38 which is received within tube 28 of member 12. As seen in FIG. 3, tube 38 is dimensioned to fit within tube 28 somewhat snugly, with sufficient clearance between the two to permit the former to be rotated and slideably raised and lowered within the latter. In FIG. 1, tip member 14 is shown in a lowered position, wherein the upper portion of tube 38 is adjacent the upper edge 39 of post 12. In FIGS. 2, 4, tip 14 is shown shifted to a raised position, wherein such portion is spaced apart from edge 39.

The upper edge of tube 38 is capped by a plate 40, on which is mounted, as by welding, a tubular guideway 42 having a plate 44 attached at one of its ends. With reference to FIG. 4, plate 44 is a chain-engaging member defining a slotted opening 46. The central circular portion of opening 46 is dimensioned to allow passage of chain 24 therethrough, and the opposed slots, such as slot 46*a*, are dimensioned to engage links of the chain, to lock the chain to plate 44 in a conventional manner. Guideway 42 is flared adjacent plate 44 to accommodate the width of opening 46.

Sleeve 16 is a tubular section encircling tube 38, with the sleeve's lower edge 50 being supported on the upper edge 39 of the post. As seen in FIG. 3, the inner diameter of sleeve 16 is approximately equal that of tube 28. Tip member 14 may be slideably raised and lowered relative to sleeve 16, and sleeve 16 may be independently rotated relative to post 12 and tip member 14. Attached to sleeve 16, as by welding, and extending radially outwardly therefrom, is a triangular mounting member 51 (shown partially in FIG. 3) used in mounting the hoist arm to the sleeve in the manner to be described.

Arm 18 includes a tube 52 having formed at the inner arm end 54 a pair of opposed vertical slots (not shown), dimensioned to receive therein portions of member 51 as arm 18 is pivoted thereon. Adjacent these slots, and spaced at right angles thereto are a pair of opposed openings (not shown). Pivot means, more specifically a pin 56 extending through these openings and an opening in member 51, pivotally mounts the arm to the sleeve.

Mounted on the hoist arm for raising and lowering a load from the end thereof, is hoist means generally including a hoist line 57, pulley means including a pulley 59 over which the hoist line is trained, and drum means for taking in and paying out the hoist line. With reference to FIGS. 1 and 2, the drum means includes a conventional line-winding apparatus indicated generally at 61. Included in this apparatus is a drum (not shown) upon which line 57 is wound, and a lever 63 operatively connected to the drum through a pawl and rachet mechanism. Movement of lever 63 causes the line to be wound or unwound, depending upon the pawl position, as is conventional. The rear portion of apparatus 61 is mounted on arm 18, adjacent arm end 54, by a hook 65 connecting the apparatus to an arm mounting plate 67.

Attached to arm 18 at a point on the arm spaced apart from end 54 and preferably at the outer arm end 60, is a second tubular guideway 58. Guideways 42, 58 are dimensioned to receive slideably therethrough opposite end portions of chain 24. The chain is adjustably fastened to plate 44 adjacent guideway 42 in the manner described above. Chain 24 is secured to guideway 58 by attachment of pulley 59 to the chain's free end adjacent this guideway. With reference to FIG. 2, it can be appreciated that with arm 18 extended, and one end of chain 24 locked to plate 44 as described, a load attached to hoist line 57 produces a tension on the chain tending to prevent movement of the chain within guideway 58. The length of chain 24 stretched between guideways 42, 58 is referred to herebelow as the effective length of the chain. With chain 24 attached to arm end 60 as just described, plate 44, defining opening 46, provides locking means for selectively varying the effective length of the chain.

The operation of the hoist of the present invention will now be described. With reference to FIG. 1, hoist 10 is shown mounted in the rear region of the bed of a pickup truck, here indicated fragmentarily, with the hoist being bolted to truck bed floor 36. To place the hoist in its collapsed position illustrated in FIG. 1, arm 18 is swiveled and lowered to a substantially horizontal position adjacent the upper edge of truck bed wall 37, and member 14 is shifted to its lowered position. The effective length of chain 24 is adjusted, as described above, to maintain the arm in the substantially horizontal position shown. In such position the hoist occupies a minimum of storage space within the bed of the truck, and extends only slightly above the sides thereof.

When it is desired to use the hoist, hoist arm 18 and member 14 are swiveled to a desired radial position with respect to the bed of the truck, with guideways 42, 58 being maintained substantially aligned. After disengaging chain 24 from a slot 46a, hoist arm 18 is pivoted to extend outwardly from the post at a desired angle. To secure arm 18 at this position, member 14 is raised by slideably raising member 14, relative to member 12 and sleeve 16 to a height at which plate 40 is spaced apart from the upper edge of the post, as shown in FIG. 2. Chain 24 is then locked between the two guideways in stretched position by sliding the chain into one of slots **46*a* of opening 46, as described. As can be appreciated with reference to FIG. 2, the stretched chain serves to maintain the distance between the two guideways, establishing the desired angular position of hoist arm 18 relative to post 12**, and also establishing the raised position of the tip member.

A portable hoist adapted to be placed within the bed of a truck, wherein the hoist arm can be moved to a desired radial and position and height, and held thereat by a simple mechanism providing an advantageous support for the hoist arm, has thus been disclosed. Various changes and modifications in the above-described invention may be made without departing from the spirit of the invention.

It is claimed and desired to secure by Letters Patent:

1. A height-adjustable hoist comprising an upright post, a hoist arm and mounting means mounting one end of said arm adjacent the top of said post with the arm extending outwardly from said post at an angle, said mounting means including pivot means accommodating pivoting of the arm in a substantially upright plane, a tip member mounted on said post for extension upwardly from said post and said mounting means, hoist means including pulley means attached to the other end of said arm opposite said one end, a line trained over said pulley means and means for paying out and taking in said line, nonextensible means extending from said tip member to a point on said arm spaced from said one end for establishing the angle of said arm relative to said post, and the extension of said tip member relative to said post, and locking means for selectively varying the effective length of said nonextensible means.

2. The hoist of claim 1 wherein said mounting means further comprises a swivel member which is relatively rotatably mounted on said post for swiveling about an upright axis, said pivot means pivotally mounting said hoist arm on said swivel member.

3. The hoist of claim 1 wherein said nonextensible means includes a chain extending from said tip member to said other end of said arm, and said locking means includes a chain-engaging member secured to said tip member.

4. A height-adjustable hoist comprising, an upright tubular post, a sleeve relatively rotatably mounted adjacent the top of said post for rotation about an upright axis, a hoist arm pivotally mounted at one of its ends on said sleeve for pivoting in a substantially upright plane, and extending outwardly from said post at an angle, a tubular tip member rotatably mounted within said post having an upper end positioned above said sleeve and extensible upwardly from the post and sleeve by lifting said upper end upwardly, hoist means including pulley means attached to the other end of said opposite said one end, a line trained over said pulley means and drum means for paying out and taking in said line, nonextensible means extending from said upper end of said tip member to a point on said arm spaced from said one end, for establishing the angle of said arm relative to said post, and the extension of said tip member relative to said post, and locking means for selectively varying the effective length of said nonextensible means.

5. The hoist of claim 4, wherein said nonextensible means includes a chain extending from said tip to said other arm end, and said locking means includes a chain-engaging member secured to said tip member.

6. The hoist of claim 5, which further comprises first and second guideways mounted on said tip member and said other arm end, respectively, for receiving portions of said chain therethrough, with said first guideway having a sloted plate which forms said chain-engaging member, said chain being fastened adjacent said second guideway by attachment of said pulley to said chain.

* * * * *